US005862640A

United States Patent [19]

Negri

[11] Patent Number: 5,862,640

[45] Date of Patent: Jan. 26, 1999

[54] PROTECTIVE WALLS AND METHOD OF CONSTRUCTION

[76] Inventor: Yermiyahu Negri, 4 Recanati Street, Tel Aviv, Israel

[21] Appl. No.: 673,293

[22] Filed: Jun. 28, 1996

Related U.S. Application Data

[63] Continuation-in-part of Ser. No. 272,405, Jul. 8, 1994, abandoned.

[30] Foreign Application Priority Data

Jan. 10, 1992 [IL] Israel ..... 100624

[51] Int. Cl.[6] ..... E04B 1/12

[52] U.S. Cl. ..... 52/565; 52/438

[58] Field of Search ..... 52/437–439, 259, 52/565, 583.1

[56] References Cited

U.S. PATENT DOCUMENTS

| | | | |
|---|---|---|---|
| 1,884,319 | 10/1932 | Mith | 52/438 |
| 2,106,387 | 1/1938 | Warren | 52/437 |
| 2,994,162 | 8/1961 | Frantz | 52/438 |
| 3,112,578 | 12/1963 | Rosenfeld | 52/439 X |
| 3,170,267 | 2/1965 | Rosenfeld | 52/438 X |
| 3,222,830 | 12/1965 | Ivany | 52/438 X |
| 3,968,615 | 7/1976 | Ivany | 52/439 |
| 4,004,385 | 1/1977 | Kosuge | 52/439 X |
| 4,091,587 | 5/1978 | Depka . | |
| 4,167,840 | 9/1979 | Ivany | 52/439 X |
| 4,237,670 | 12/1980 | De Walel | 52/439 X |
| 4,325,457 | 4/1982 | Docherty et al. . | |
| 4,577,447 | 3/1986 | Doran | 52/571 |
| 4,731,968 | 3/1988 | Obino | 52/565 X |
| 5,048,250 | 9/1991 | Elias | 52/437 |

FOREIGN PATENT DOCUMENTS

| | | |
|---|---|---|
| 998957 | of 0000 | France . |
| 2612971 | 3/1987 | France . |

OTHER PUBLICATIONS

"Wood Concrete Brances Out" by Ralph Ironman

*Primary Examiner*—Carl D. Friedman
*Assistant Examiner*—Beth A. Aubrey
*Attorney, Agent, or Firm*—Harness, Dickey & Pierce, P.L.C.

[57] ABSTRACT

For absorbing blast energy in a composite block and reinforced concrete wall construction, a hollow block formed of a mixture of mineralized wood shaving and concrete and having a density of no more than approximately 1 ton per cubic meter. The block has formed therein openings extending in mutually orthogonal directions for permitting the placement therethrough of reinforced concrete, and is operative to cooperate with the reinforced concrete so as to resist blast forces.

6 Claims, 3 Drawing Sheets

PROTECTIVE WALLS AND METHOD OF CONSTRUCTION

This application is a continuation-in-part of Ser. No. 08/272,405, filed Jul. 8, 1994, now abandoned.

FIELD OF THE INVENTION

The present invention relates, in general, to bomb blast resistant constructions and, in particular, to the use of block constructions as bomb-blast resistant walls.

Background of the Invention

Traditionally, bomb shelters are steel reinforced concrete structures, usually built at ground or below-ground level, having especially thickened and reinforced concrete walls. A disadvantage of conventional bomb shelters is, however, that as they are located at or below ground level, they are particularly susceptible to chemical attack, as the chemicals normally used may have a density greater than that of air, and they thus accumulate in low places close to ground level. This problem was faced by authorities in Israel during the Gulf War of 1990–1991, when it was necessary to advise civilian populations how best to take cover when under missile attack, as it was suspected that the missiles carried chemical warheads.

It would thus be desirable to construct the upper stories of buildings, such as apartments and offices, so as to be blast resistant. This however, is impractical as concrete reinforced walls constructed to the thickness conventionally required would present an acute weight burden on the structure and if a number of such walls were to be erected in a building, the overall additional weight may cause unacceptable weakening thereof, resulting in structural failure.

Moreover, there is a serious problem with existing buildings that do not have bomb shelters to retrofit them with blast resistant rooms, preferably on each floor or even in each apartment.

Varying methods, techniques and building materials have been suggested for imparting particular properties to walls. Thus composite structures including an arrangement of hollow blocks having a plurality of communicating voids filled with a reinforced concrete construction are known, per se. Such constructions, employing cinder or concrete blocks, are disclosed in U.S. Pat. No. 1,884,319 to Smith and U.S. Pat. No. 2,994,162 to Frantz. Smith describes his structure as being employed to provide insulation against "heat, cold and moisture". Frantz states that his construction is simply easier to erect than other block wall constructions. U.S. Pat. No. 4,577,447 to Doran discloses a similar construction to those in the above-referenced patents, but employing expanded polystyrene blocks.

U.S. Pat. No. 4,167,840 to Ivany discloses improving the reinforcement of hollow-concrete-block masonry walls with vertical and horizontal reinforcing bars while pouring concrete into the hollow voids of the blocks. The wall thus becomes a solid reinforced wall with the wall surfaces being of concrete masonry.

French Patent No. 2,612,971 describes a well-known DURISOL(R) building block made from 'wood concrete', which is essentially a mixture of wood shavings and concrete. As indicated in an article by Ralph Ironman, entitled "Wood Concrete Branches Out," published in the August 1988 edition of CONCRETE PRODUCTS, these wood concrete building blocks are known to be light weight, have thermal and acoustic insulation properties, fire retardant, frost resistant and rot-proof and are used to impart one or more of these specific properties to structures built with them.

SUMMARY OF THE INVENTION

It is an object of the present invention to provide a bomb blast resistant construction which can be constructed in place of or in addition to substantially any selected wall portion of a building, thereby providing bomb blast protection to the interior side of that wall portion.

A further object of the present invention is to provide a lightweight, easy-to-erect construction which has bomb blast resistance properties, and which thus substantially maintains its structural integrity in the face of a bomb blast.

A still further object of the invention is to provide a blast resistant and gas impermeable wall construction.

In particular, it is sought to employ mineralized hollow wood concrete blocks in composite construction with a reinforced concrete grid, such a construction having been found by the Inventor to achieve the above-stated objects of the present invention. The Inventor discovered that the flexibility of the composite blocks of mineralized wood shavings and concrete is substantially greater than that of a standard masonry building block, and the energy absorption of these blocks results in a major improvement in blast resistance characteristics.

In accordance with a preferred embodiment of the invention, there is thus provided, for absorbing blast energy in a composite block and reinforced concrete wall construction, a hollow block formed of a mixture of mineralized wood shaving and concrete and having a density of no more than approximately 1 ton per cubic meter. The block has formed therein openings extending in mutually orthogonal directions for permitting the placement therethrough of reinforced concrete, and is operative to cooperate with the reinforced concrete so as to resist blast forces.

A preferred composite block comprises a pair of parallel walls of mineralized wood shaving and concrete, spaced apart by gas impermeable bridging means such as metal plates embedded in the walls.

In accordance with a further embodiment of the invention, there is also provided a method of constructing a wall by using the above blocks so as to impart blast resistance to the wall, wherein the method includes the following steps:

assembling in a wall arrangement a plurality of the above hollow blocks, so as to place the blocks in direct contact on top of and next to one another such that the vertical and horizontal voids of adjacent blocks are interconnecting; and forming an integral web of concrete and steel reinforcement in the interconnecting vertical and horizontal voids, thereby to form a composite wall construction of the hollow blocks and reinforced concrete, wherein the steps of assembling the plurality of hollow blocks and forming an integral web impart to the composite wall construction the ability to substantially retain its structural integrity in the presence of blast forces of a magnitude sufficient to destroy a block and reinforced concrete wall not employing the hollow blocks.

Additionally in accordance with the method, the step of assembling a plurality of hollow blocks includes assembling the plurality of hollow blocks adjacent to a selected portion of a reinforced concrete structure, and the step of forming an integral web includes the steps of placing steel reinforcement in the interconnecting vertical and horizontal voids such that ends of the reinforcement protrude beyond the block assembly, and pouring the concrete in the vertical and horizontal voids, wherein the method also includes the additional step of embedding the steel reinforcement extending beyond the wall in the reinforced concrete structure, thereby to attach the composite wall construction to the reinforced concrete structure so as to protect the selected portion of the reinforced concrete structure from blast forces.

In accordance with yet a further embodiment of the invention, therefore, there is provided a blast resistant wall formed of the above blocks and which includes a construction of the above blocks placed in direct contact on top of and next to one another; and an interconnected web of vertical and horizontal steel reinforced concrete beams disposed in the voids, wherein the construction of energy absorbing blocks and the web of reinforced concrete beams cooperate so as to resist forces resulting from a blast.

Additionally in accordance with an embodiment of the invention, the wall also includes a reinforced concrete frame, wherein the construction of hollow blocks is erected within the frame, and the reinforcement of the web of reinforced concrete is anchored to the frame.

BRIEF DESCRIPTION OF THE DRAWINGS

The invention will be more fully understood and appreciated from the following detailed description taken in conjunction with the drawings, in which.

DETAILED DESCRIPTION OF THE INVENTION

Figure 1:
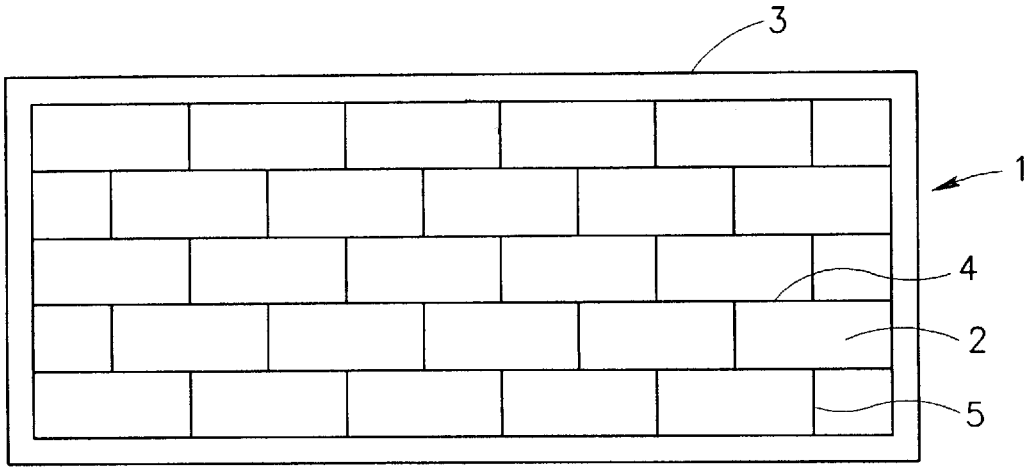
FIG. 1 is a front elevational view of a protective wall constructed in accordance with this invention.

Referring now to FIG. 1, there is shown a composite wall construction 1 formed of an assembly of building blocks 2 which are made of a mixture of mineralized wood shaving and concrete and an integral web of reinforced concrete extending within the block assembly. This is described in detail below in conjunction with FIGS. 3 and 4.

Preferably the hollow building blocks are "DURISOL (R)" blocks, composed of mineralized wood shavings and concrete. These blocks are lightweight, having a density of approximately 0.9 tons per cubic meter, as opposed to approximately 2.4 tons per cubic meter for concrete blocks. They also have desirable characteristics with respect to fire resistance and sound absorption, as well as thermal insulation.

Composite walls constructed with blocks and having an internal reinforced concrete beams are known as such in conventional construction. However, the combination of DURISOL(R)-type blocks for use with an integral reinforced concrete web such as described herein for providing blast proof protective walls is unknown. Furthermore notwithstanding the various qualities attributed to DURISOL (R) material in the art, the Inventor is not aware of any disclosure indicating blast-resistance qualities either of an individual block per se, or of a composite block reinforced concrete construction as described, employing DURISOL (R) blocks. The Inventor was thus surprised to learn, upon comparative testing of different wall constructions, including that of the present invention, that the present composite construction using DURISOL(R) blocks provided the only substantial resistance to blast forces. These comparative tests are discussed hereinbelow.

Furthermore, it was surprisingly found that walls can be constructed with DURISOL(R) blocks in accordance with this invention as internal double walls in existing buildings, thus making it possible to provide blast shelters in every apartment on every floor by merely constructing such a wall against any outside wall in any room.

Referring once again to FIG. 1, the illustrated wall is typically constructed within a frame 3 of reinforced concrete. The surface finish on the blocks 2 is naturally decorative enough to be suitable for the interior of an apartment, without requiring further finishing.

The wall consists of blocks 2 placed on top of one another 4 and next to each other 5 without any spaces left between blocks, thus not requiring any caulking or grouting which would detract from the attractive natural surface of the wall.

Figure 2A:
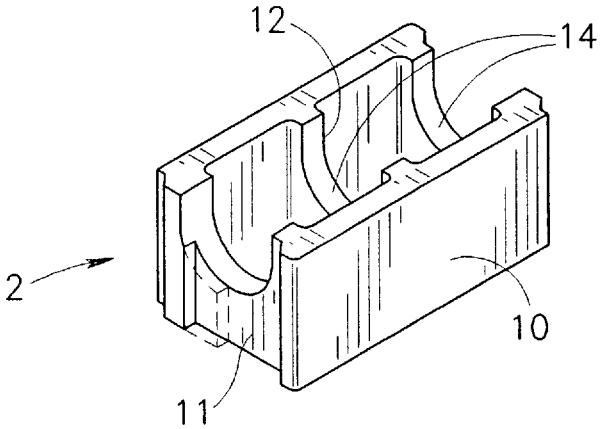
FIGS. 2*a,* 2*b* and 2*c* are respectively a perspective, top and side view of a DURISOL(R) wood concrete block, used for constructing a wall according to this invention.
Figure 2B:
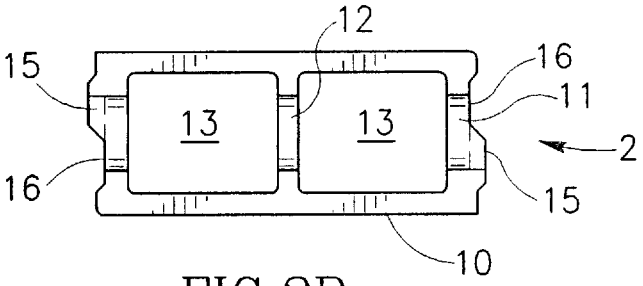
Figure 2C:
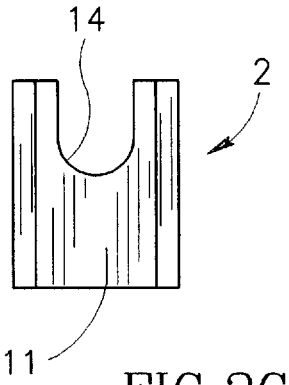

For a better understanding of the construction of this wall, we refer to FIGS. 2*a,* 2*b* and 2*c,* which illustrate the basic building block suitable for the construction of wall 1. The DURISOL(R) blocks 2 are composed, as stated above, of a mixture of mineralized wood shaving and concrete, and they have been found to have a high energy absorption capability. They also have very good characteristics with respect to fire resistance, sound absorption and thermal insulation.

These blocks 2 are similar to prior art blocks in dimensions and have front walls 10 and side walls 11 and generally have a center partition wall 12, leaving two hollow sections 13. The side walls 11 and partition 12 have their upper ends grooved 14 to enable steel reinforcing rods to be placed therein. Side walls 11 further include a longitudinal extension 15 across about one half of the width of the wall, this extension serving as a tongue for fitting into a corresponding groove 16 when the blocks are placed alongside one another.

Figure 5A:
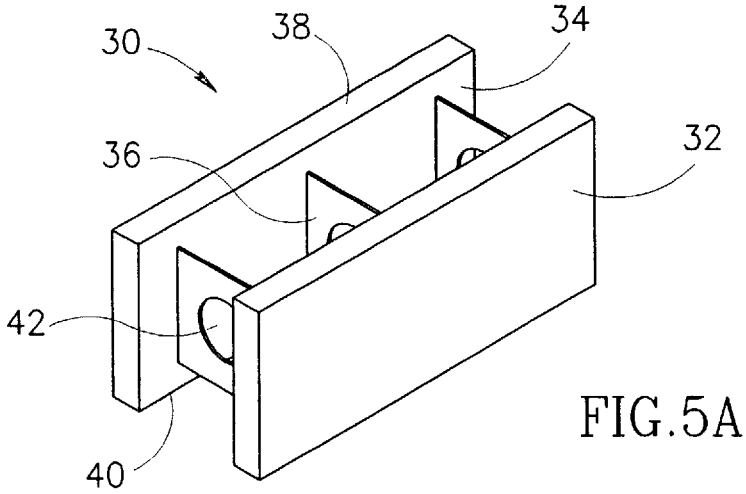
FIGS. 5*a*, 5*b* and 5*c* are respectively a perspective, top and side view of another embodiment of a wood-concrete block used for constructing a wall according to this invention.
Figure 5B:
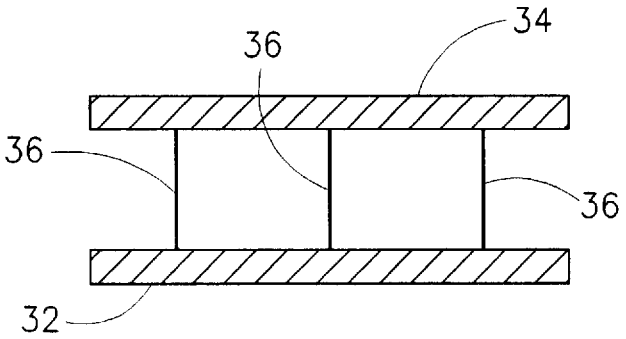
Figure 5C:
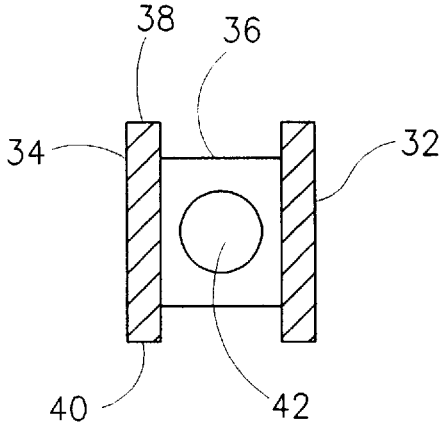

With reference to FIGS. 5*a* to 5*c,* there is shown another suitable building block for use in this invention, particularly suitable for imparting in addition to blast resistance also gas impermeability. The block 30, an integral unit that can be of standardized dimensions, is comprised of two parallel walls 32 and 34 that are connected by metal plate bridging elements 36. The bridging elements 36 are integral with the walls, being embedded when the walls are cast, and form partitions between walls 32 and 34. Elements 36 do not bridge the walls 32 and 34 along their entire height, but rather leave spaces between the bridge 36 and the top 38 and bottom 40 of the walls 32 and 34, so that reinforcing rods can be placed therein. Optionally the block 30 may have apertures 42 in the bridging elements 36 to allow concrete poured into the block 30 to flow more freely to fill the entire interior of the block 30. The reason for using metal bridges 36 rather than the same material for the bridges and walls is that the wood-concrete blocks are somewhat porous and thus permeable to gases. If the bridges were also to be made of this material, then a porous path would result from one side of the block through to the other side of the block even after the voids were filled with reinforcing rods and concrete. By forming a complete concrete and metal separation between block walls, gases cannot permeate through the block.

Figure 3:
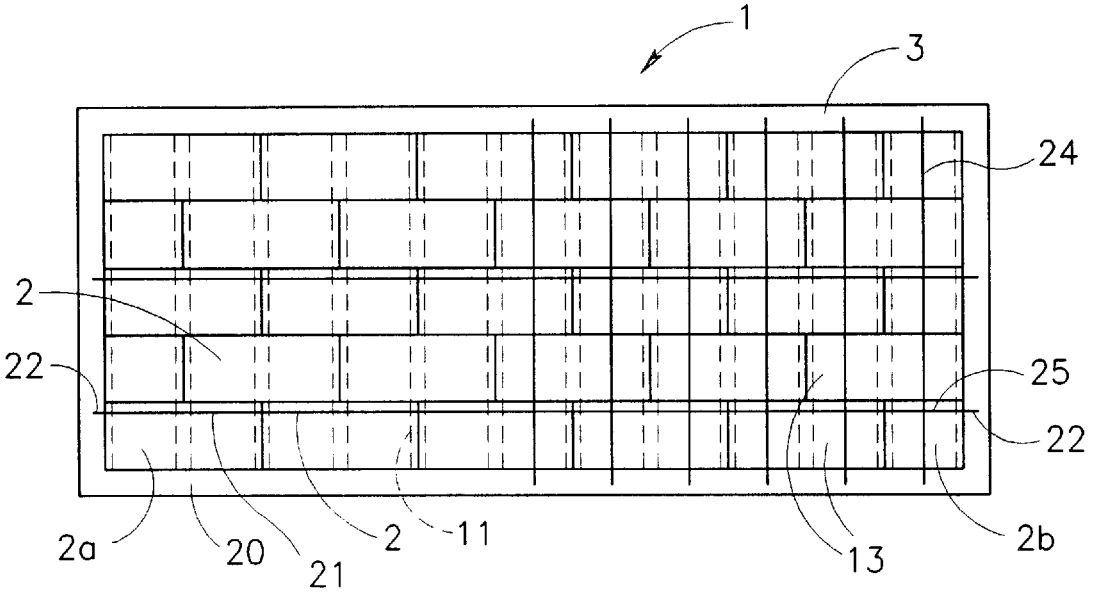
FIG. 3 is a cross-sectional view of the front of the wall of FIG. 1.
Figure 4:
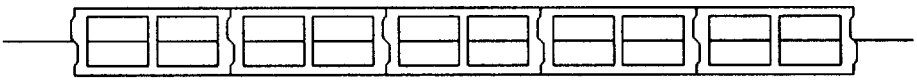
FIG. 4 is a cross-sectional view as seen from the top of the wall of FIG. 1.

In constructing the wall according to this invention, for example, in the case of a free-standing wall, there is first poured a reinforced concrete frame bottom 20, as shown in FIG. 3, and the blocks 2 are placed thereon in a row adjacent one another. Steel reinforcement 21 is then placed horizontally within the trough formed by the adjacent grooves 14 of the blocks 2 extending 22 beyond the terminal blocks 2*a* and 2*b*.

A second layer of blocks 2 is placed staggered on top of the first layer, so that the partitions 12 are aligned above the walls 11 of the blocks with the hollow sections 13 forming vertical cavities. Further rows of blocks are added up to the desired height of the wall. Steel reinforcing rods 24 are introduced vertically into the cavities 13 and concrete is then poured into these cavities 13 to fill the voids and form a web of vertical and horizontal steel reinforced concrete beams within the blocks.

In the illustrated embodiment, the terminal ends 22 of the steel reinforcing rods are then embedded in concrete which completes the reinforcing frame 3 around the wall 1. The terminal ends of the vertical rods 24 are embedded in the frame bottom 20 prior to full hardening of the frame bottom 20, or by insertion into pre-drilled holes.

Alternatively, the vertical steel reinforcing rods 24 can be inserted into the cavities 13 of the blocks 2 after the first layer of blocks and horizontal steel rods 21 have been placed in position and tied to the horizontal steel rods 21 where they cross each other 25. Subsequent layers of blocks are then slipped over the vertical steel reinforcing rods 24 and placed in position with the vertical and horizontal steel bars being tied together wherever they cross each other.

When such a protective wall is constructed in an existing apartment, the protective wall is connected via the reinforcing steel to the reinforced concrete framework of the building.

Additional strengthening of the protective wall may be accomplished by providing prestressing (or post-tensioning) at the top and bottom and on either side of the wall. This strengthens the membrane or wall formed by the DURISOL (R) blocks and also strengthens its connection to the framework.

In order to test the blast resistance of different types of wall, the Inventor conducted comparative tests. Five types of wall were tested, including a) A wall consisting of conventional masonry building blocks internally reinforced with concrete and steel bars similar to Ivany, U.S. Pat. No. 4,167,840;

b) A wall constructed of conventional building blocks to which plates of ferro-cement were glued on their inside surface to provide reinforcement;

c) A wall made of solid blocks of silicate;

d) A wall made of ITONG(R) blocks reinforced with beams; and e) A wall made of DURISOL(R) blocks according to the invention.

All these walls were approximately 3.6 m long and 2.75 m high and reinforced with concrete beams all around.

An explosive device was detonated equidistant from all the walls. Examination of the walls subsequent to the testing showed that the wall constructed of DURISOL(R) blocks in accordance with the present invention had sufficient elasticity to absorb the blast, making the wall completely blast resistant. The other walls were all deformed or crumbled. This showed that the present wall construction proved far superior to the other walls a)–d) constructed in accordance with prior art, and which underwent varying degrees of destruction.

It will be appreciated by persons skilled in the art that the scope of the present invention is not limited to what has been shown and described hereinabove, merely by way of example. Rather, the scope of the invention is limited solely by the claims, which follow.

What is claimed is:

1. A blast resistant energy absorbing composite wall comprising:

a construction of lightweight hollow building blocks placed in direct contact on top of and next to one another, each of said hollow blocks having formed therein interconnected vertical and horizontal voids; and an interconnecting web of vertical and horizontal steel reinforced concrete disposed in and completely filling said voids, characterized in that said hollow blocks having parallel outer walls formed of a mixture of mineralized wood shavings and concrete and having a density of no more than approximately 1 ton per cubic meter, said parallel outer walls being spaced apart by gas impermeable bridging elements, said composite wall retaining its structural integrity in the presence of blast forces of a magnitude sufficient to destroy a comparable concrete and steel reinforced wall employing concrete building blocks.

2. A blast resistant wall according to claim 1 wherein said gas impermeable bridging elements are metal plates.

3. A blast resistant wall according to claim 1, wherein said gas impermeable bridging elements of said blocks comprise gas impermeable metal bridging elements.

4. A hollow building block providing energy absorbing elasticity for constructing a blast resistant and gas impermeable barrier composite wall, said block comprising:

two spaced apart exterior walls connected by gas impermeable bridging elements, said spaced apart walls and bridging elements defining openings in said block extending in mutually orthogonal directions for permitting the placement therethrough of reinforced concrete, characterized in that said spaced apart walls are made from material having blast resistant absorbing elasticity selected from a mixture of mineralized wood shavings and concrete having a density of no more than one ton per cubic meter, whereby when said blocks are constructed in a composite vertical and horizontal steel reinforced concrete wall structure, the wall structure will be blast resistant and gas impermeable when subjected to blast forces of a magnitude sufficient to destroy a comparable reinforced concrete wall employing concrete building blocks.

5. A hollow building block according to claim 4, wherein said gas impermeable bridging elements comprise gas impermeable metal bridging elements.

6. A hollow building block according to claim 4, wherein the said gas impermeable bridging elements are metal plates.

* * * * *

UNITED STATES PATENT AND TRADEMARK OFFICE

CERTIFICATE OF CORRECTION

PATENT NO. : 5,862,640
DATED : January 26, 1999
INVENTOR(S) : Yermiyahu Negri

It is certified that error appears in the above-identified patent and that said Letters Patent is hereby corrected as shown below:

On the Title Page, under "U.S. Patent Documents", reference 4,237,670, "De Walel" should be --De Waele--.

Signed and Sealed this

Twenty-ninth Day of June, 1999

*Attest:*

*Attesting Officer*

Q. TODD DICKINSON

*Acting Commissioner of Patents and Trademarks*